US012075950B2

(12) United States Patent
Chalko et al.

(10) Patent No.: US 12,075,950 B2
(45) Date of Patent: Sep. 3, 2024

(54) AUTO-DROP DISPENSER

(71) Applicant: Kimberly-Clark Worldwide, Inc., Neenah, WI (US)

(72) Inventors: Eric M. Chalko, Alpharetta, GA (US); Jae Gu, Atlanta, GA (US); Thomas Cahoon, Atlanta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 308 days.

(21) Appl. No.: 17/772,584

(22) PCT Filed: Oct. 31, 2019

(86) PCT No.: PCT/US2019/059018
§ 371 (c)(1),
(2) Date: Apr. 28, 2022

(87) PCT Pub. No.: WO2021/086361
PCT Pub. Date: May 6, 2021

(65) Prior Publication Data

US 2022/0369871 A1 Nov. 24, 2022

(51) Int. Cl.
*A47K 10/36* (2006.01)

(52) U.S. Cl.
CPC .. *A47K 10/3687* (2013.01); *A47K 2010/3681* (2013.01)

(58) Field of Classification Search
CPC ..... A47K 10/3687; A47K 10/405
See application file for complete search history.

(56) References Cited

U.S. PATENT DOCUMENTS

| | | | |
|---|---|---|---|
| 3,650,487 | A | 3/1972 | Bahnsen |
| 4,137,805 | A | 2/1979 | Deluca et al. |
| 4,203,562 | A | 5/1980 | DeLuca et al. |
| 4,422,584 | A | 12/1983 | Dashnier et al. |
| 4,844,361 | A | 7/1989 | Granger |

(Continued)

FOREIGN PATENT DOCUMENTS

| | | | |
|---|---|---|---|
| CH | 695822 | A5 | 9/2006 |
| CN | 105873485 | A | 8/2016 |

(Continued)

OTHER PUBLICATIONS

Williams Medical, Tork Compact Auto Shift Toilet Roll System, https://www.wms.co.uk/Paper Products/Paper_Dispensers/Tork_Compact_Auto_Shift_Toilet_Roll_System, 2019, 1 page.

(Continued)

*Primary Examiner* — William A. Rivera
(74) *Attorney, Agent, or Firm* — Dority & Manning, P.A.

(57) ABSTRACT

A drop assembly for a paper product dispenser is provided that transitions an upper carriage for a second roll of paper product into a primary or first position after depletion of a first or primary roll of paper product without user intervention. The drop assembly transitions the upper carriage into approximately the same position previously occupied by the lower carriage, allowing a small aperture in a front face of a dispenser to be used. Additionally, the drop assembly can include a reset connection to transition the drop assembly back to the firsts position upon opening of a dispenser front face.

20 Claims, 16 Drawing Sheets

(56) References Cited

U.S. PATENT DOCUMENTS

| | | | | |
|---|---|---|---|---|
| 5,690,299 | A | 11/1997 | Perrin et al. | |
| 6,138,939 | A * | 10/2000 | Phelps | A47K 10/38 242/596.7 |
| 6,382,553 | B1 | 5/2002 | Lewis et al. | |
| 6,752,349 | B2 * | 6/2004 | Moody | A47K 10/38 242/599.3 |
| 7,913,945 | B2 | 3/2011 | Friesen et al. | |
| 7,967,235 | B2 | 6/2011 | Forman et al. | |
| 8,439,293 | B2 | 5/2013 | Heagleitner | |
| 8,496,198 | B2 * | 7/2013 | Cittadino | A47K 10/3687 242/560 |
| 9,138,110 | B2 * | 9/2015 | Knight | A47K 10/38 |
| 9,635,986 | B2 | 5/2017 | Phelps | |
| 10,213,070 | B2 | 2/2019 | Osborne, Jr. | |
| 11,142,419 | B2 * | 10/2021 | Osborne, Jr. | B65H 16/021 |
| 2006/0054733 | A1 * | 3/2006 | Moody | A47K 10/36 242/563 |
| 2006/0236836 | A1 * | 10/2006 | Cassia | A47K 10/3643 83/649 |
| 2008/0078855 | A1 | 4/2008 | Forman et al. | |
| 2009/0266928 | A1 | 10/2009 | Friesen et al. | |
| 2009/0266929 | A1 * | 10/2009 | Friesen | A47K 10/3687 242/560 |
| 2011/0226883 | A1 * | 9/2011 | Forman | B65H 49/322 242/160.4 |
| 2013/0320130 | A1 * | 12/2013 | Osborne, Jr. | A47K 10/3845 242/561 |
| 2019/0104895 | A1 * | 4/2019 | Johnson | A47K 10/3687 |
| 2020/0305656 | A1 * | 10/2020 | Landa | A47K 10/3687 |

FOREIGN PATENT DOCUMENTS

| | | | |
|---|---|---|---|
| CN | 108289575 | A | 7/2018 |
| CN | 109310247 | A | 2/2019 |
| JP | 1998014817 | | 1/1998 |

OTHER PUBLICATIONS

European Search Report Corresponding to Application No. 19951075.1 on Jun. 15, 2023.

Chinese Office Action Corresponding to Application No. 201980101849.9 on Sep. 27, 2023.

International Search Report for PCT/US2019/059018 dated Jul. 24, 2020, 3 pages.

* cited by examiner

AUTO-DROP DISPENSER

RELATED APPLICATIONS

The present application is the National Stage entry of International Patent Application No. PCT/US2019/059018 filed on Oct. 31, 2019, which is incorporated herein by reference.

BACKGROUND

Vertically-stacked dispensers for dispensing multiple rolls of a paper product are often desirous for applications such as washroom environments. Particularly, vertically-stacked dispensers decrease the number of times that a dispenser needs to be replenished. However, many existing vertically-stacked dispensers allow access to the second, or reserve roll of paper product, creating problems with uneven usage and decreased hygienics. For instance, existing vertically-stacked dispensers often have a large opening in the front of the dispenser order to reach the paper product from both the primary and reserve rolls, which allows a user to take the paper product from either roll, contaminating the reserve roll and allowing usage of the reserve roll prior to exhaustion of the primary roll.

Alternatively, some vertically-stacked dispensers have a smaller opening in the dispenser in order to limit access to the reserve roll. Such vertically-stacked dispensers generally utilize a mechanism for "dropping" or moving a reserve roll into a position that can be accessed from the opening, or move the opening from a bottom of the face of the dispenser to the top, or vice-a-versa. However, these dispensers generally require complex systems or user intervention, or alternatively, fail to drop the reserve roll an optimal distance which makes access to the reserve roll difficult or continues to necessitate a larger than desired opening. Therefore, existing drop vertically-stacked dispensers suffer from the same deficiencies as discussed above, namely, continue to suffer from contamination and mixed-use of the primary and reserve rolls, instead of use of the primary roll until depletion.

Therefore, in one aspect, it would be beneficial to provide a paper product dispenser that overcomes one or more of the above noted deficiencies. For instance, in one aspect, it would be advantageous to provide a drop assembly for a paper product dispenser that moved or "dropped" a reserve roll of paper product, or a holder therefore, into generally the same position as had been previously occupied by the primary roll, or holder therefore, after depletion of the primary roll. Furthermore, it would be a benefit to provide a drop assembly that would move or drop a reserve roll, or a holder thereof, automatically upon depletion of the primary roll without require a complex assembly or user intervention. It would be a further benefit to provide a drop assembly for a paper product dispenser that may be used with existing holders. Additionally, in one aspect, it would be beneficial to provide a dispenser with a drop assembly that only allows access or visibility to one roll at a time. In yet a further aspect, it would be an advantage to provide a drop assembly for a dispenser that resets the primary roll, and/or holder thereof, and the reserve roll, and/or holder thereof, to an original, or pre-depletion location upon the opening of the dispenser.

SUMMARY

In one aspect, the present disclosure is directed to a drop assembly for a tissue dispenser that has a first position and a second collapsed position. The drop assembly includes an upper carriage, a lower carriage having a lock, and a carriage support extending between the lower carriage and the upper carriage. Furthermore, at least one of the upper carriage, the lower carriage, or both the upper carriage and lower carriage include a roll holder, where the carriage support releases at least one of the upper carriage, lower carriage, or both the upper carriage and lower carriage when the lock is unlocked, transitioning the drop assembly from the first position to the second collapsed position.

In a further aspect, the drop assembly in the first position has a first height from a center of the roll holder of the lower carriage to a center of the roll holder of the upper carriage. Furthermore, in one aspect, the drop assembly in the second position has a second height from the center of the roll holder of the lower carriage to the center of the roll holder of the upper carriage that is less than the first height.

Additionally or alternatively, in an aspect, the upper carriage defines a first location in the first position and the lower carriage defines a first location in the first position, and the upper carriage defines a second location in the second collapsed position and the lower carriage defines a second location in the second collapsed position. In one aspect, the location of the upper carriage is defined by a center of the roll holder of the upper carriage, wherein the second location is approximately the same as the first location of the lower carriage. Furthermore, in one aspect, the location of the lower carriage is defined by a center of the roll holder of the lower carriage, wherein the second location of the lower carriage is below the first location of the lower carriage.

In yet a further aspect, the lower carriage also includes at least one reset connection. Moreover, in an aspect, the lock is maintained in the locked position by contact on an inner side of the lower carriage, where the lock is unlocked when the contact is removed. In one aspect, the contact is provided by a roll of paper product. Furthermore, in an aspect, the contact is removed when the paper product reaches a diameter that is about 30% or less of an original diameter of the paper product. In yet a further aspect, the roll holder is configured to releasably secure a roll of paper product to the at least one of the upper carriage, lower carriage, or both the upper carriage and lower carriage.

Nonetheless, the present disclosure is also generally directed to a paper product dispenser that includes a housing having at least one aperture and at least one drop assembly having a first position and a second collapsed position. The drop assembly includes an upper carriage, a lower carriage having a lock, and a carriage support extending between the lower carriage and the upper carriage, where at least one of the upper carriage, lower carriage, or both the upper carriage and lower carriage include a roll holder, and where the support connection releases the at least one of the upper carriage, lower carriage, or both the upper carriage and lower carriage when the lock is unlocked, transitioning the drop assembly from the first position to the second collapsed position.

In one aspect, the dispenser contains a back wall and a front face, where the front face is at least partially releasable from the back wall, and where the at least one aperture is located in a lower portion of the front face. Additionally or alternatively, in an aspect, the aperture is sized such that only the lower carriage is accessible through the aperture in the first position and the upper carriage is accessible through the aperture in the second position. Furthermore, in an aspect, the upper carriage is located in an upper region of the housing in the first position, and the lower carriage is located in a lower region of the housing in the first position. Moreover, in one aspect, in a second position, the upper carriage is located in the lower region of the housing in approximately the same location as the lower carriage in the first position.

Furthermore, in an aspect, each of the at least one drop assemblies further contain at least two rolls of paper product, where a first roll of paper product is releasably affixed to a roll holder on the upper carriage and a second roll is releasably affixed to a roll holder on the lower carriage, such that the first roll is vertically stacked above the second roll, wherein the second roll maintains the lock in the compressed position. In one aspect, the lock is unlocked when the second roll reaches a diameter that is about 30% or less of an initial diameter of the second roll. Additionally or alternatively, in one aspect, the tissue dispenser comprises at least two drop assemblies, where a first drop assembly is located adjacent to a second drop assembly.

BRIEF DESCRIPTION OF THE DRAWINGS

The invention will now be described, by way of example, with reference to the accompanying drawings, in which.

DEFINITIONS

Figure 1:
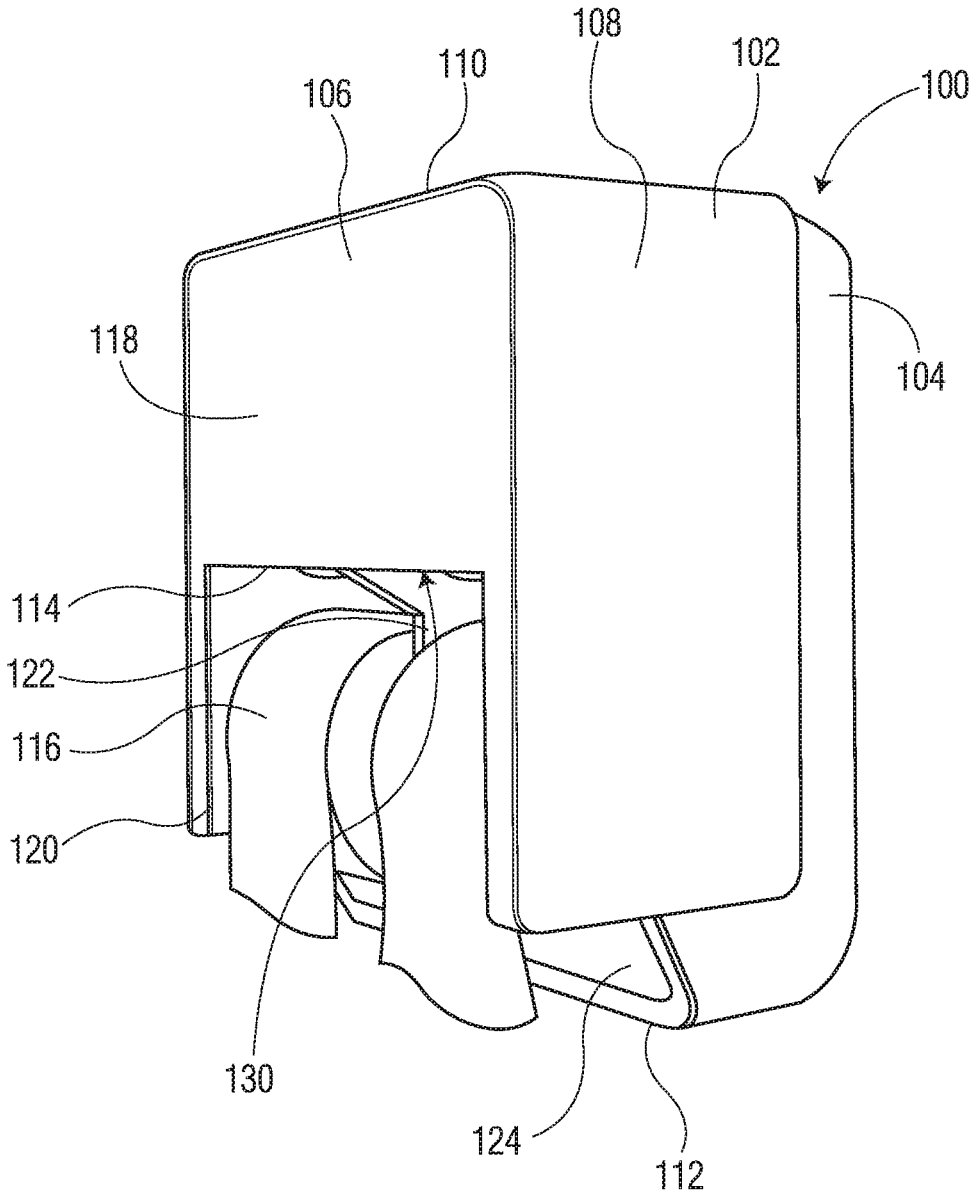
FIG. 1 is perspective view of a dispenser.

As used herein, the terms "about," "approximately," or "generally," when used to modify a value, indicates that the value can be raised or lowered by 5% and remain within the disclosed embodiment.

DETAILED DESCRIPTION

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Generally speaking, the present disclosure is directed to a drop assembly for a paper product dispenser that automatically transitions an upper carriage from a reserve position to a primary position (e.g., approximately the original position of a lower carriage) when a lock on the lower carriage is released. Particularly, the present disclosure has found that a linked system can be used in conjunction with a mechanical activation system such that only a single pivot or connection point is needed between the upper and lower carriages, and the drop assembly automatically transitions the upper carriage into a position to be accessed through an aperture in a dispenser housing. In such a manner, the present disclosure has been found that an aperture in a dispenser housing sized for access to a single roll of paper product may be used in conjunction with a vertically-stacked dispenser, improving the sanitation of the paper product dispenser and also controlling the order in which the paper product is used. Furthermore, the present disclosure has also found that the drop assembly may be used in conjunction with a reset assembly, such that the upper carriage and lower carriage may be automatically returned to their original positions upon opening of the housing, improving the sanitation and ease in which the paper product is replenished. Moreover, the present disclosure has further found that the drop assembly according to the present disclosure may also be used in conjunction with existing dispenser housings, such that one or more drop assemblies may be used to retrofit existing vertically-stacked dispensers.

For instance, referring to FIG. 1, a dispenser 100 is generally shown that may be used in conjunction with a drop assembly (shown more clearly in later figures) according to the present disclosure. Of course, as discussed above, in one aspect, the drop assembly and dispenser may form a single unit, or alternatively, the dispenser may be outfitted at a later time with a drop assembly according to the present disclosure. Furthermore, as may be understood by one having skill in the art, the dispenser may be a dispenser for a paper product, such as a bath tissue, including toilet paper, paper towels, and the like. The paper product may be a standard core, split core, coreless, or other orientation as is known in the art, and as will be discussed greater below, may be used with a drop assembly according to the present disclosure. Thus, it should be one having skill in the art that other forms of paper products in roll form may be used with the drop assembly herein.

Nonetheless, in one aspect, the dispenser 100 may be formed from a housing 102 that includes a back wall 104 and a front face 106. As shown in FIG. 1, in one aspect, at least one of the front face 106, the back wall 104, or both the front face 106 and the back wall 104 have one or more sidewalls 108. However, in one aspect, the one or more sidewalls 108 may also be part of a continuous piece that that forms the front face 106 or back wall 104. Similarly, at least one of the back wall 104, front face 106, or both the front face 106 and back wall 104 may have an upper wall 110 and/or a lower wall 112. Of course, as discussed with the one or more sidewalls, in one aspect the upper wall 110 and/or lower wall 112 may instead be part of a continuous piece that forms the front face 106 and/or back wall 104. Regardless of the configuration, the front face 106 may be releasable from the back wall 104, in order to gain access to an interior cavity 130 of the dispenser 100, such as by a latch (not shown) on one or more of the side walls, upper wall 110, or lower wall 112.

Furthermore, in one aspect the front face may have an aperture 114 that allows access to a lower carriage (shown with a roll of paper product 116 thereon in FIG. 1), but restricts access to an upper carriage (shown more clearly in later figures), when the drop assembly is in the first position. Particularly, as shown, when a paper product 116 is located on the lower carriage, access to the upper carriage is restricted. Thus, in such an aspect, the aperture 114 may be sized such that only a lower support is accessible in the first position, as the upper carriage remains in an upper region 118 of the housing 102, such that the upper carriage is only accessible in the collapsed position.

Furthermore, as generally shown in FIG. 1, in one aspect, the dispenser, whether formed as a unit with the drop assembly or retrofitted at a later time, may have a shape and size that accommodates two drop assemblies adjacent to one another. In such an orientation, a first drop assembly may have an upper carriage and lower carriage (to be shown and discussed hereafter) which is adjacent to a second drop assembly having an upper carriage and a lower carriage, such that the upper carriage of the first drop assembly and second drop assembly are located adjacent to one another in an upper region 118 of the housing 102, and the lower carriage of the first drop assembly and second drop assembly are located adjacent to one another in a lower region 120 of the housing 102. Furthermore, as shown in FIG. 1, in an aspect where two or more drop assemblies are located adjacent to one another, a dividing wall 122 may be located between each drop assembly. However, the dividing wall 122 may be omitted based upon the dispenser 100 to be used.

Finally, the housing 102 may also include a lower compartment 124. The lower compartment 124 may have a size sufficient to receive a spent roll from a paper product. In one aspect, a housing 102 according to the present disclosure may include a lower compartment 124 for such a purpose, or alternatively, the drop assembly may be placed in such a manner in an existing housing to leave an appropriate amount of space between the lower carriage and the lower wall 112 of the front face 106 or back wall 104.

Figure 2A:
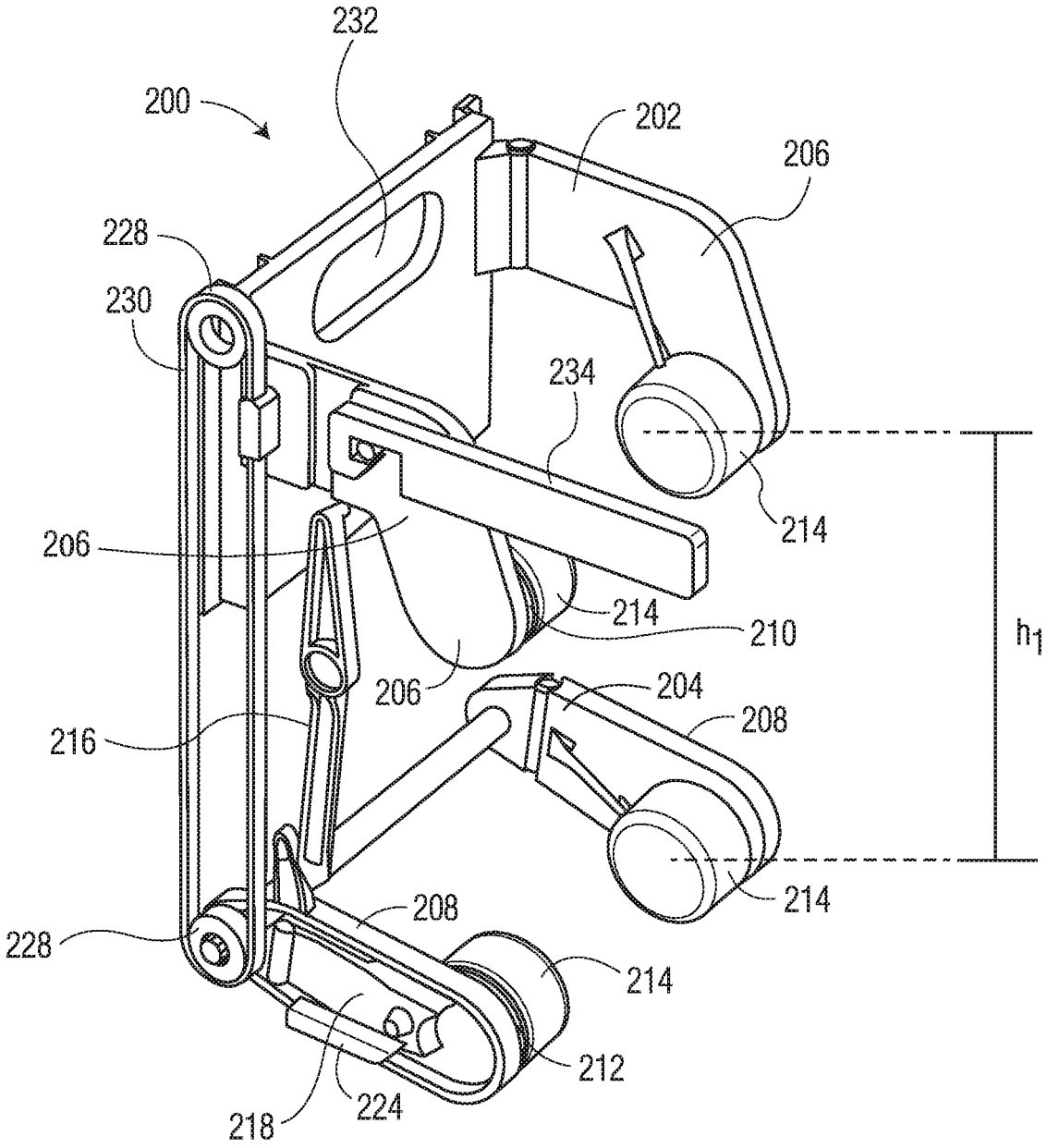
FIG. 2A is a perspective view of a drop assembly according to an aspect of the disclosure.

Regardless of the housing selected, an aspect of a drop assembly will be discussed in regards to FIGS. 2A-2E. Referring first to FIG. 2A, a drop assembly 200 includes an upper carriage 202 and a lower carriage 204. As shown in FIG. 2A, in one aspect, both the upper carriage 202 and lower carriage 204 include a set of opposed arms 206, 208. While the upper carriage 202 and lower carriage 204 may include further orientations, in this aspect, the upper carriage 202 opposed arms 206 and lower carriage 204 opposed arms 208 each contain an opposed pair of roll holders 210, 212. As shown in FIG. 2A, in one aspect, the set of opposed roll holders 210, 212 may be adapted to hold a standard core paper product in a releasable manner. Of course, as discussed above, and as shown more clearly in FIG. 2B, it should be understood that roll holders 210, 212 may also have an adaptor 214 that is configured to interact with a paper product having a differing core arrangement. Thus, in one aspect, various adaptors 214 may be selected based upon the paper product or core thereof selected.

Nonetheless, referring again to FIG. 2A, the drop assembly 200 also includes a carriage support 216 and a lock 218. As shown, the carriage support 216 may be in a releasable contact with both the upper carriage 202 and lower carriage 204. Of course, in an aspect, the carriage support 216 may be affixed to one or more of the upper carriage 202 and lower carriage 204. Nonetheless, in the aspect shown in FIG. 2A, the carriage support 216 supports the upper carriage 202, maintaining the upper carriage 202 in the reserve position while the lock 218 of the lower carriage 204 is in the locked position.

Figure 2B:
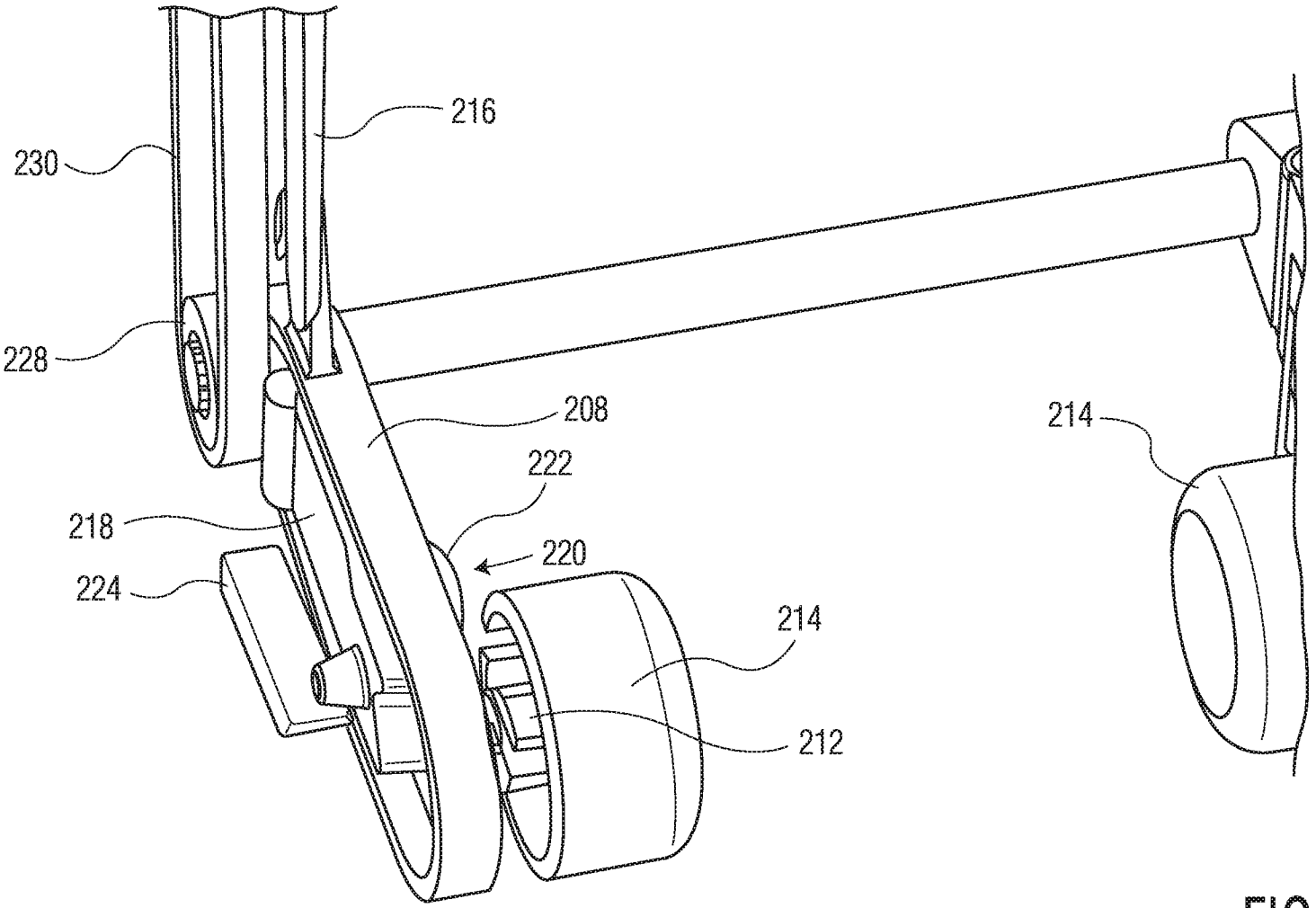
FIG. 2B is a close-up view of a lock according to FIG. 2A.
Figure 2C:
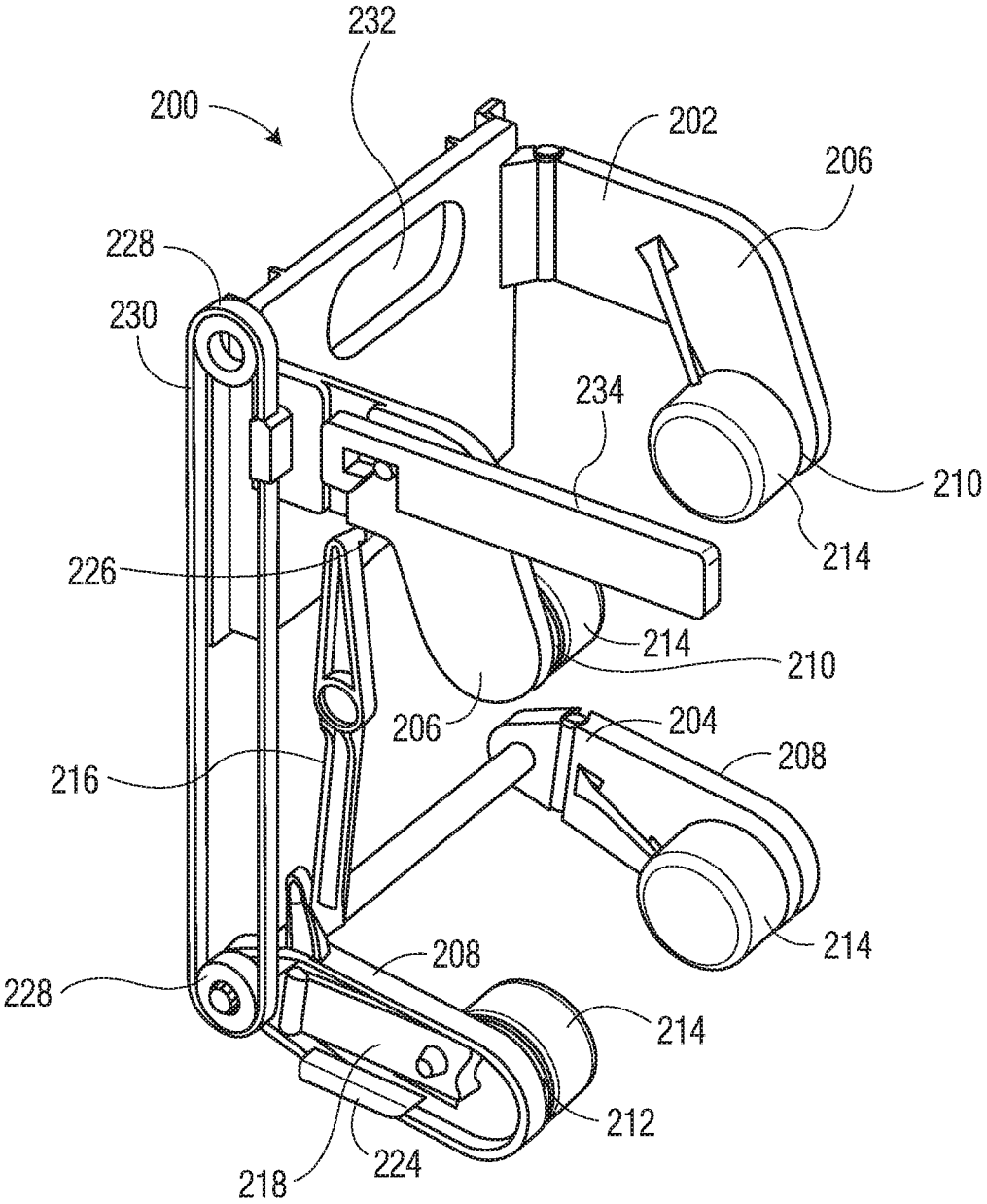
FIG. 2C is view of a drop assembly according to FIG. 2A with the lock unlocked.

Thus, referring to the lock 218 which may be shown in greater detail in FIG. 2B, the lock 218 may be maintained in the locked position by a pressure or contact from an inner side 222 of the lower support 204 (shown by the direction of arrow 220) that maintains the lock 218 in contact with a latch 224. For instance, in one aspect, a roll of paper product may provide a constant contact on the inner side 222 of the lock 218 until the diameter of the roll has been reduced to a point such that the roll no longer contacts the inner side 222 of the lock 218. Thus, in such an aspect, when the roll has been reduced in diameter, the pressure from the inner side 222 is removed, allowing the lock 218 to transition to the unlocked position (as shown by arrow 220 in FIG. 2C). For instance, in such an aspect, the lock 218 may transition to the unlocked position when the paper product reaches a diameter that is about 30% or less of an original diameter of the paper product, such as about 25% or less, such as about 20% or less, such as about 15% or less, such as about 0% to about 10% of an original diameter of the paper product. Particularly, as may be known in the art, in cored applications, the entirety of the roll may be spent but some diameter still remains due to the spent core.

Figure 2D:
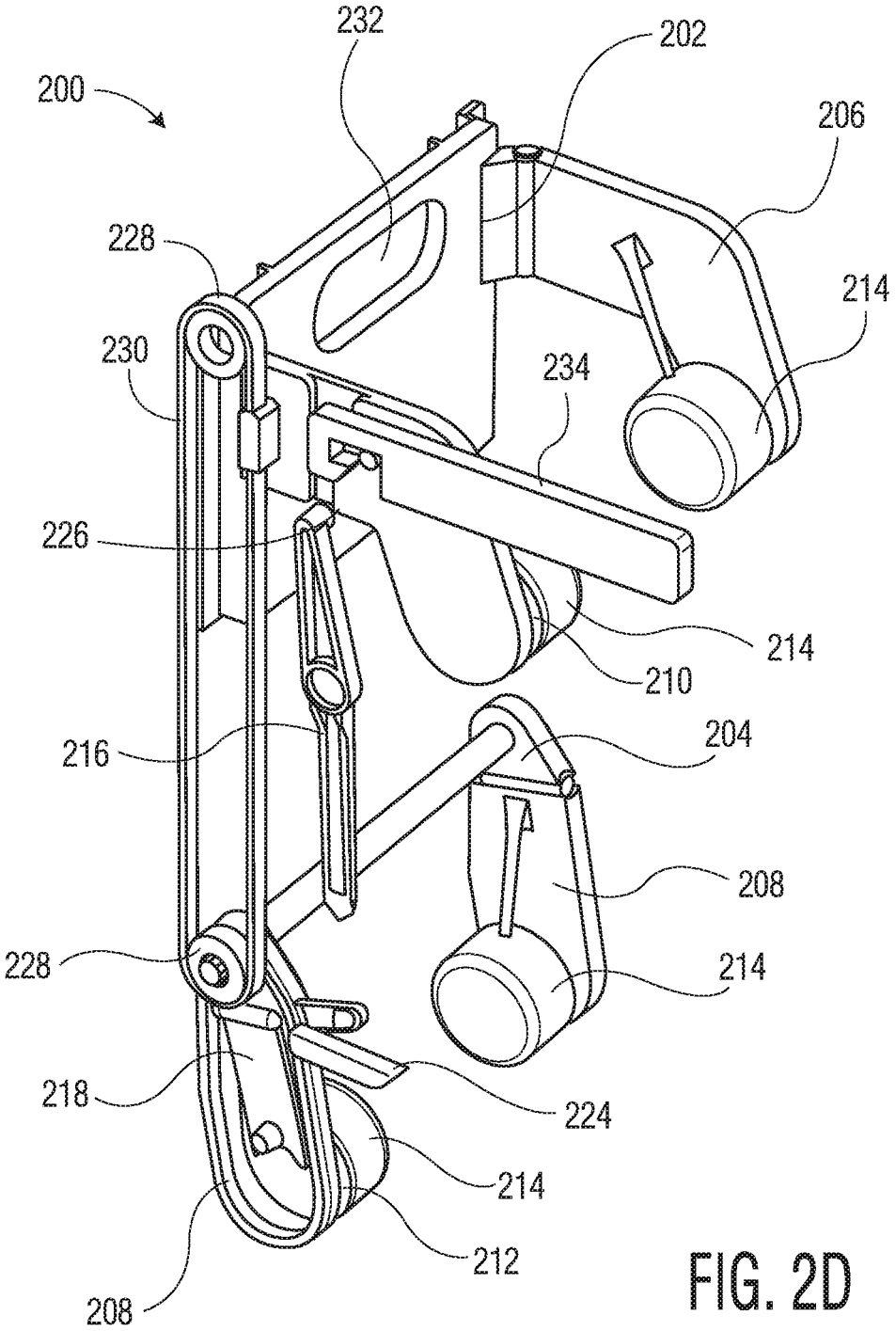
FIG. 2D is a view of a drop assembly according to FIG. 2A with the lower carriage transitioned to the collapsed position.

As shown in FIG. 2D, when the lock 218 is transitioned to the unlocked position, the lower carriage 204 is allowed to rotate into the spent position or collapsed position as the lock 218 clears the latch 224. Furthermore, as shown in FIGS. 2A-2E, the latch 224 may be attached to the side wall (not shown) of the dispenser, such that the lock 218 may disengage from the latch 2224 when unlocked. While not shown, it should be understood that the latch 224 may also be mounted to another portion of the lower carriage 204 or to the drop assembly 200, or may be formed as part of the lock 118, instead of a portion of a dispenser.

Regardless, as shown in FIG. 2D, when the lower carriage 204 transitions to the spent or collapsed position, the role holder 212 of the lower carriage 204 has a second position that is located below the initial position of the roll holder 212 of the lower carriage 204 (see, e.g. FIG. 2A v. 2D). Particularly, in one aspect, as shown in FIGS. 2A and 2D, the center of the roll holder 210 of the upper carriage 202 may define a position and the center of the roll holder 212 of the lower carriage 204 may define a position.

Figure 2E:
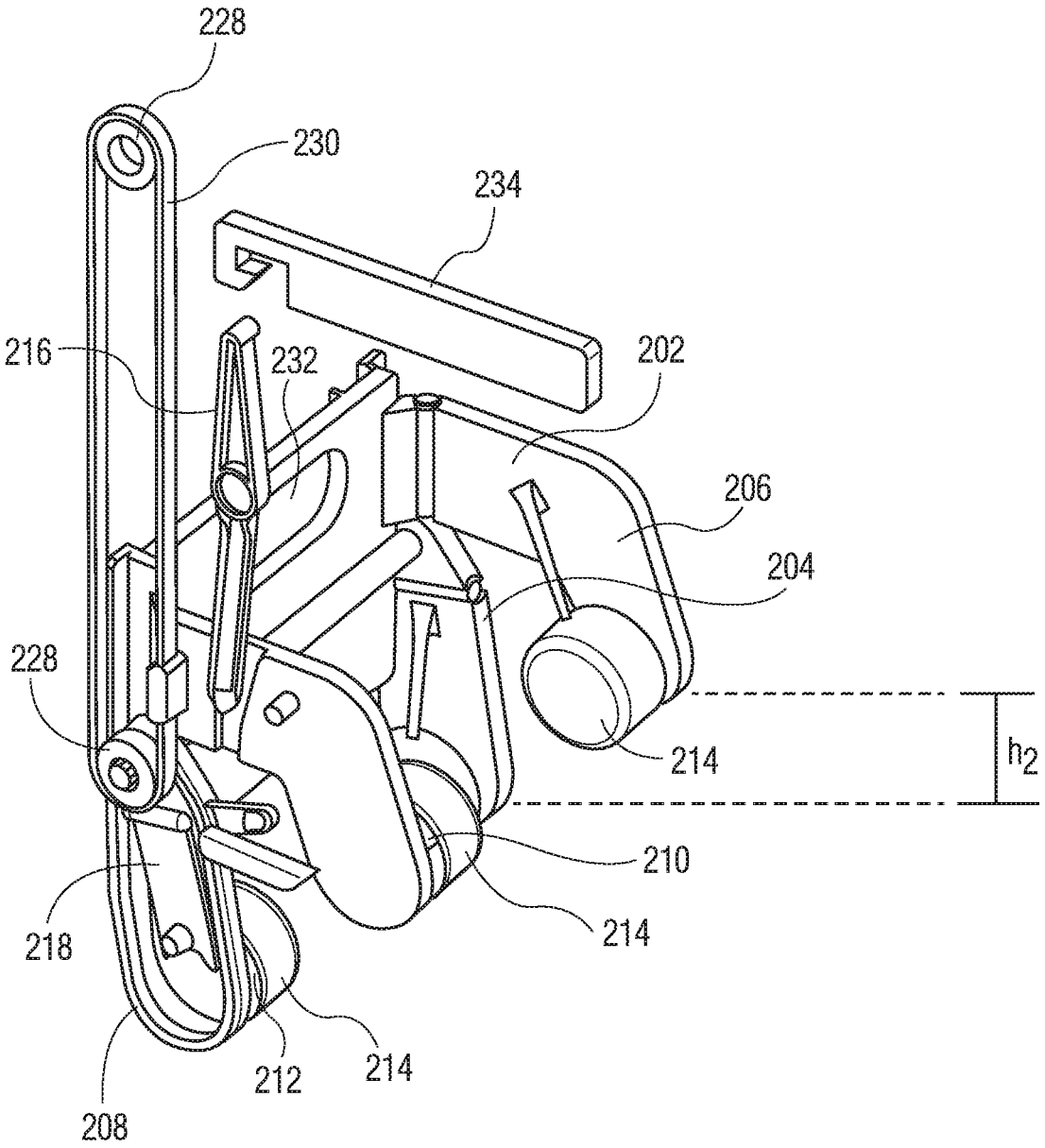
FIG. 2E is a view of a drop assembly according to FIG. 2A in the collapsed position.

Nonetheless, as shown in FIGS. 2D and 2E, the transition of the lower carriage 204 into the collapsed position also results in the carriage support 216 disengaging from the lower surface 226 of the upper carriage 202. Thus, as shown in the progression from 2D to 2E, the disengagement of the carriage support 216 from the lower surface 226 of the upper carriage 202, allows the upper carriage 202 to transition to the collapsed position, which, as shown most clearly in FIG. 2E. results in the upper carriage 202, or at least the roll holder 210 thereof, being maintained in approximately the same position as the lower carriage 204, or roll holder 212 thereof, in the first position. (see, e.g., FIG. 2*a* v. FIG. 2E).

Therefore, as shown in FIGS. 2A-2E, the upper carriage 202 may be automatically transitioned or "dropped" into the place of the lower carriage 204 upon the lock 218 being unlocked.

Furthermore, as shown in FIGS. 2A-2E, in one aspect, the drop assembly 200 may also include a pully 228 and a belt 230. For instance, the pully and belt system may allow the upper carriage 202 and lower carriage 204 to transition between the first position and the collapsed position. Of course, as is known the art and which may be discussed in greater detail herein, the pully 228 and belt 230 may also be a guide track or the like.

Finally, as shown in FIGS. 2A-2D, the drop assembly 200 may also include a door lock 234 and a reset handle 232. However, it should be understood that an automatic reset mechanism, which will be discussed in greater detail below, may also be used in conjunction with the drop assembly 200, either in addition to, or instead of, the reset handle 232.

Moreover, in a further aspect, the lock may additionally or alternatively contain an electronic element (not shown) which allows the depletion of the roll to be measured, and/or a motor to drive the drop motion. For instance, in one aspect, a motor may be used to initiate or complete the transition of the lower carriage 204 from the first position to the second collapsed position, and/or the transition of the upper carriage 202 from the first position to the second collapsed position. Of course, in one aspect, as described herein, a motor may not be necessary to initiate or complete the transition, and instead, gravity may be used. Furthermore, in one aspect, an electronic sensor may be used to initiate the lock mechanism. For instance, in one aspect, the sensor may electronically sense when a roll diameter is below a preset diameter, such as the percentages discussed above, or alternatively, may use reflection or refraction technology to detect when a core of a roll is visible, and may trigger the lock to unlock. However, as mentioned above, in one aspect, an electronic sensor is not used, and instead, a diameter sensing lock may be used.

Regardless, as shown in FIGS. 2A-2E, the drop assembly 200 allows an upper carriage 202, which may be supporting a rolled paper product on the roll support 210 thereon, to transition to a collapsed position after the depletion of a primary roll of paper product contained on a roll support 212 of a lower carriage 204 without user intervention or complex mechanisms, and using only a single pivot point on each carriage and with only a single connection point. Furthermore, as shown, the lower carriage 204 is transitioned to a position below its initial position when transitioned to the collapsed position, allowing the upper carriage 202 to drop or transition into approximately the same position as the lower carriage 204 in the first position, allowing access to the reserve roll without requiring a large opening in a housing of a dispenser. For instance, referring back to FIGS. 2A and 2E, the drop assembly 200 may have a first height $h_1$ from approximately the center of the roll supports 210 of the upper carriage 202 to approximately the center of the roll supports 212 of the lower carriage 204 in the first position, and a second height $h_2$ from approximately the center of the roll supports 210 of the upper carriage 202 to approximately the center of the roll supports 212 of the lower carriage 204 in the second collapsed position. Furthermore, as shown in FIGS. 2D and 2E, the located defined by the lower carriage 204, or the center of the holder 212 thereof, in the collapsed position is below the first location of the lower carriage 204 in the first position.

Figure 3A:
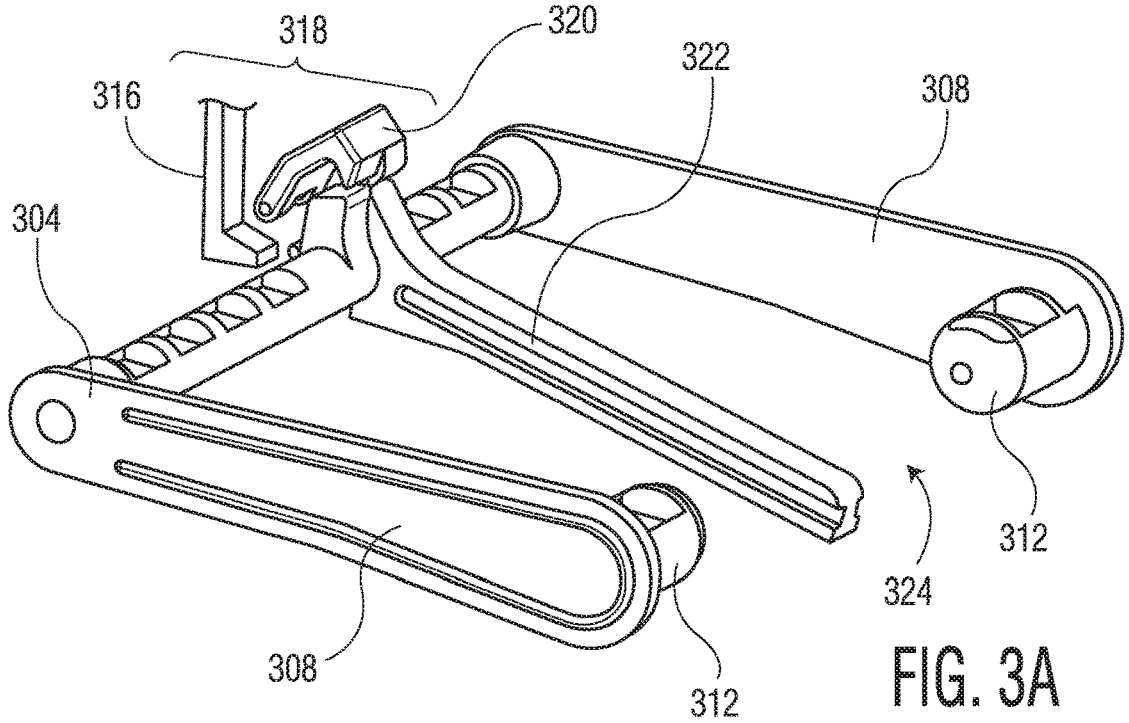
FIG. 3A is a view of a lock assembly according to an aspect of the disclosure.
Figure 3B:
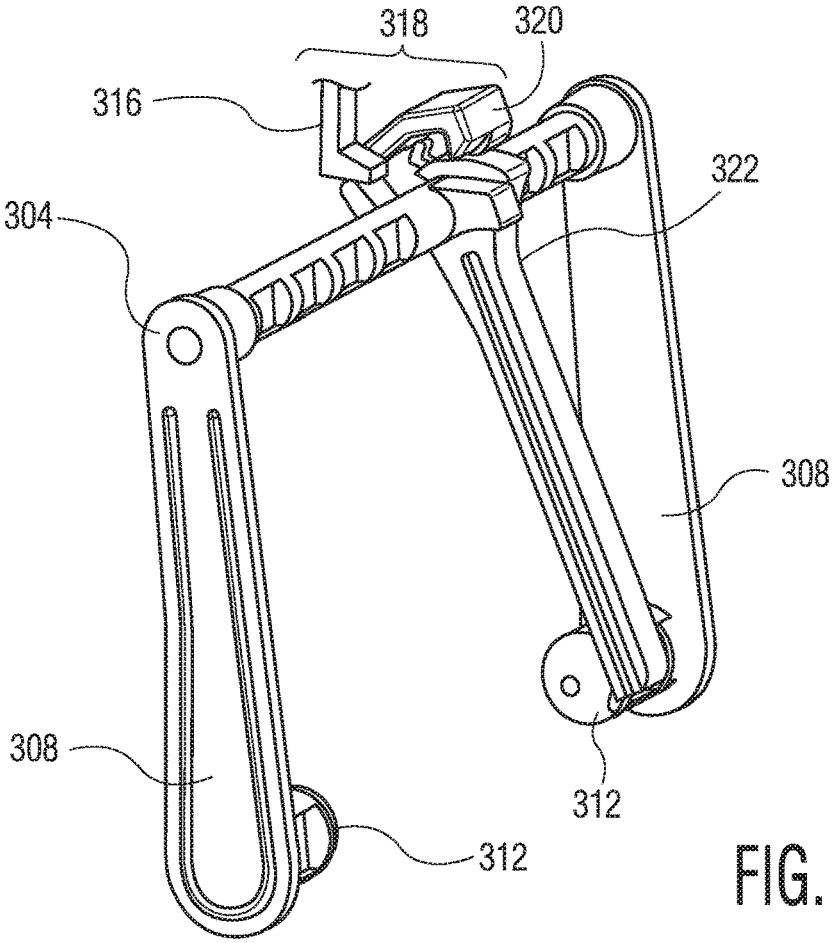
FIG. 3B is a view of the lock assembly of FIG. 3A in the unlocked position.

Referring next to FIGS. 3A and 3B, an alternative locking mechanism 318 is shown which may be used with any of the drop assemblies described herein (and should be understood that, similarly, the lock 218 of FIGS. 2A-2E may also be used with any drop assembly described herein). Nonetheless, as shown in FIG. 3A, a lower carriage 304 has arms 308 which have roll supports 312 on an end of the arms 308. The lock assembly 318 includes a latch 320 and a depletion gauge 322. For instance, the depletion gauge 322 may move in the direction of arrow 324 as a paper product contained on roll supports 312 moves towards depletion. When the paper product is depleted, the depletion gauge 322 disengages from the latch 320, which subsequently disengages from the carriage support 316, allowing the lower carriage 304 to rotate in to the collapsed position, as shown in FIG. 3B. Furthermore, as discussed above in regards to FIGS. 2A-2E, and as will be discussed below, disengagement of carriage support 316 from the lower carriage 304 also results in disengagement from the upper carriage (as shown in FIG. 2E or below), allowing the upper carriage to "drop" into the second collapsed position.

Figure 4A:
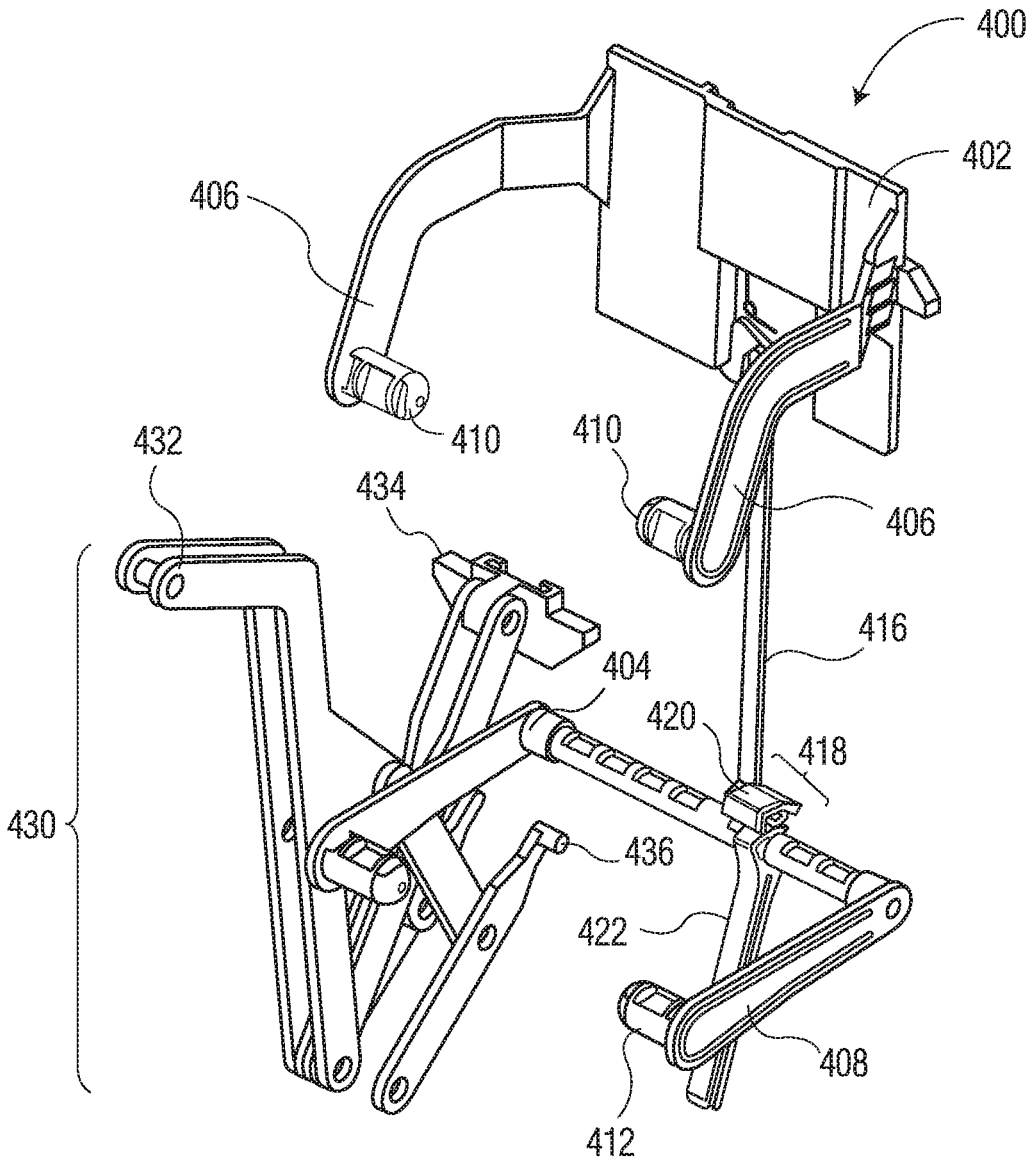
FIG. 4A is a perspective view of a drop assembly according to an aspect of the disclosure.
Figure 4B:
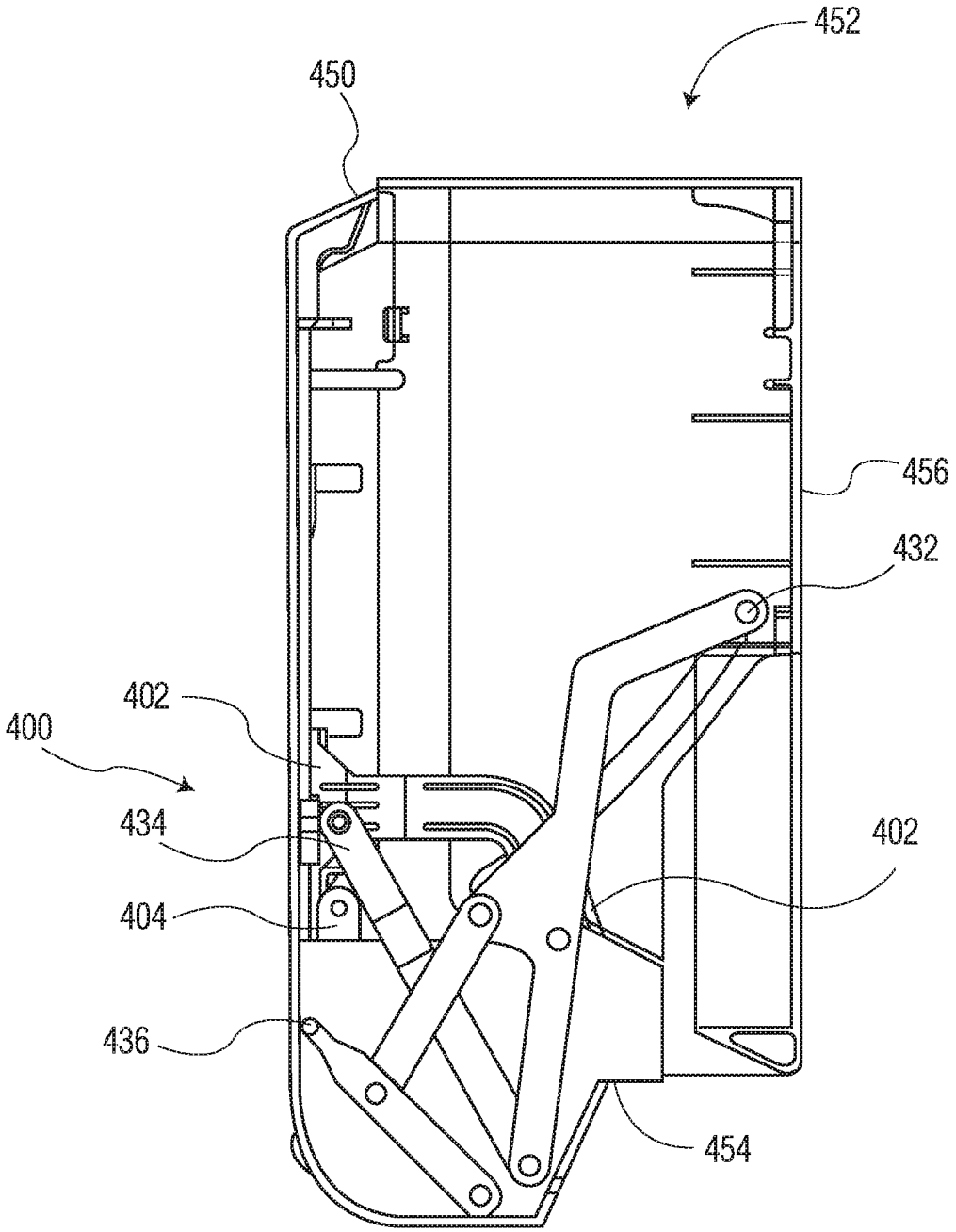
FIG. 4B is a perspective view of the drop assembly according to FIG. 4A in the collapsed position in a housing.
Figure 4C:
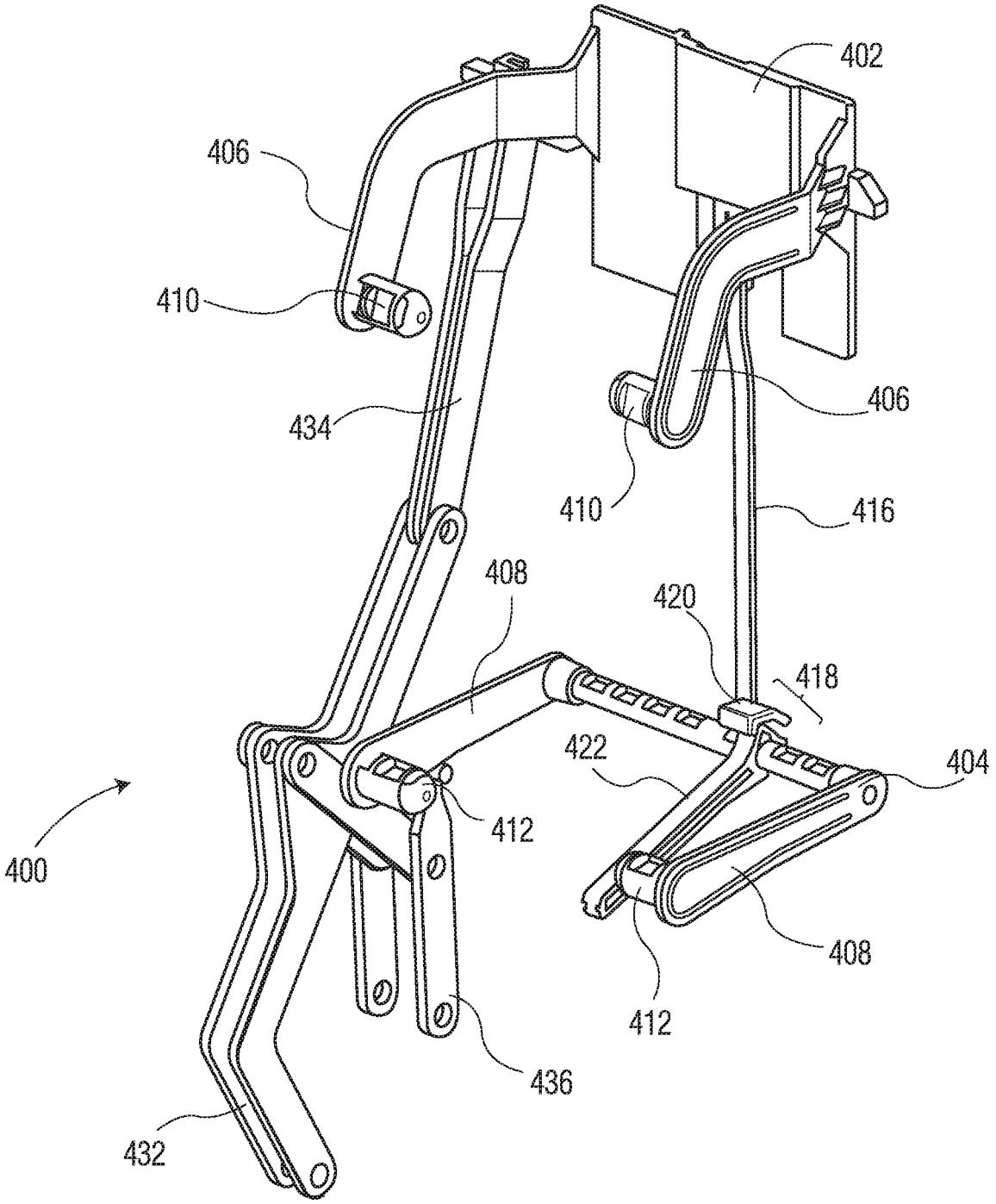
FIG. 4C is a perspective view of the drop assembly according to FIGS. 4A and 4B with the door auto-reset engaged.
Figure 5A:
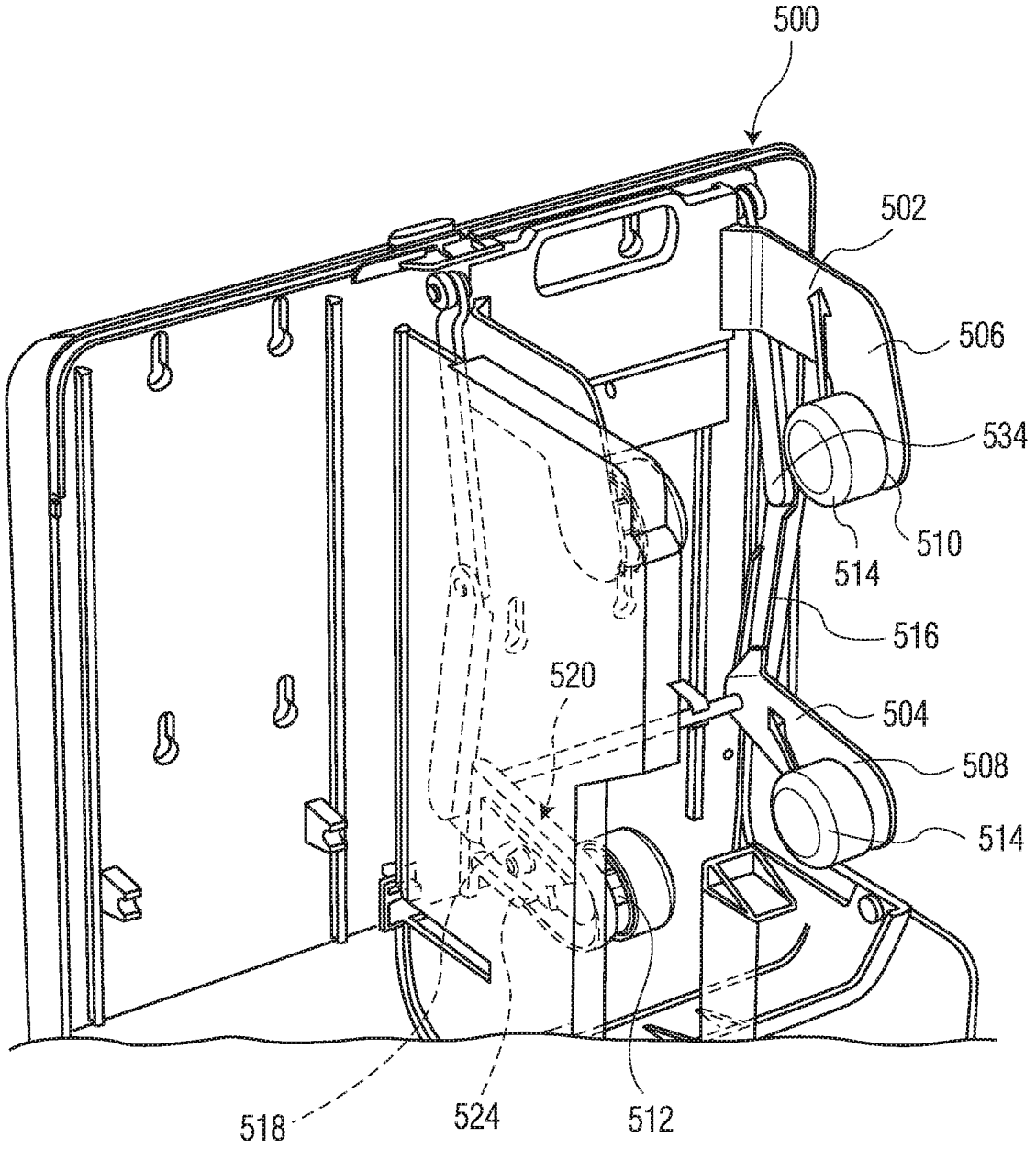
FIG. 5A is a perspective view of a drop assembly according to an aspect of the present disclosure in a housing.
Figure 5B:
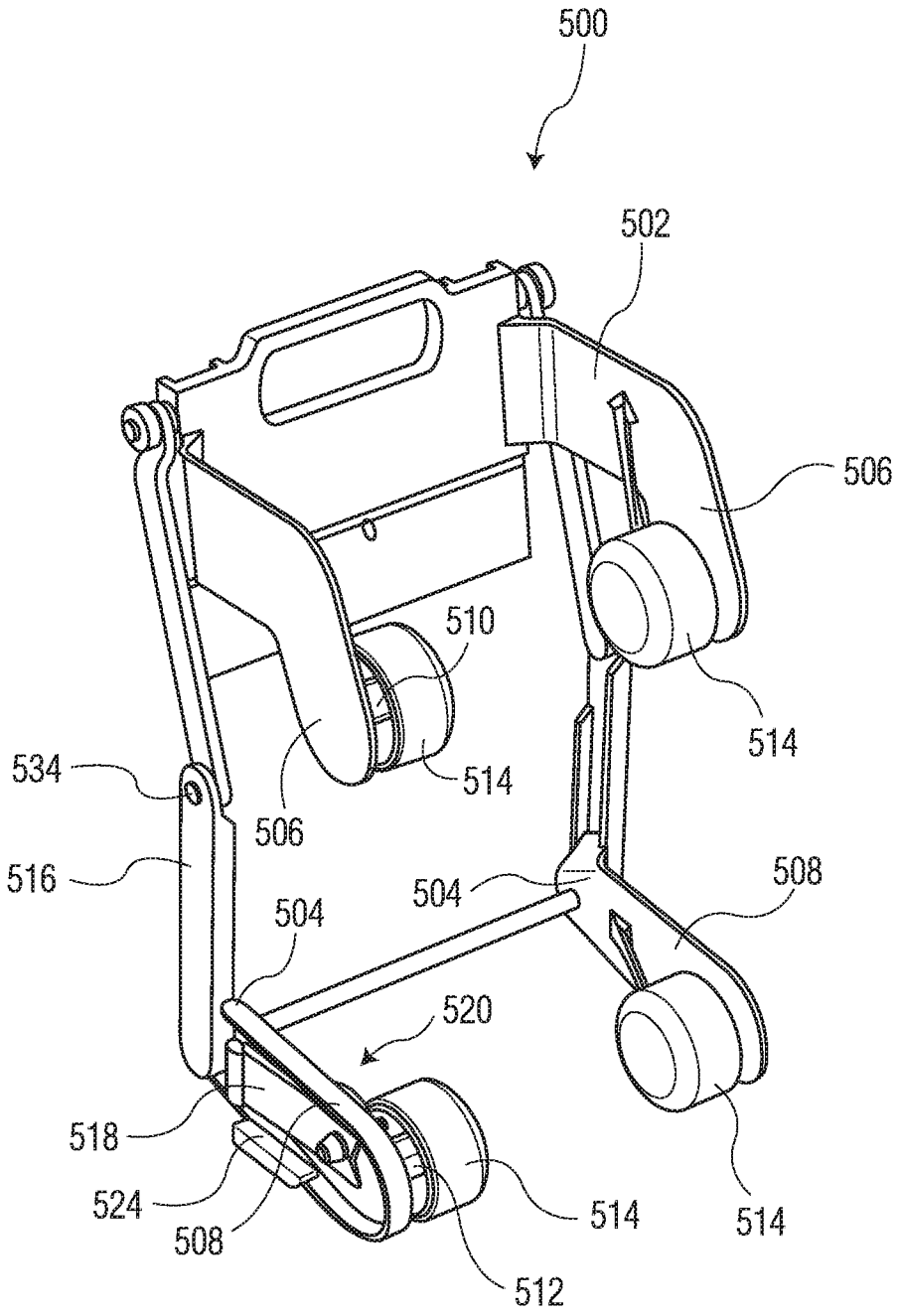
FIG. 5B is a view of the drop assembly of FIG. 5A with the lock in the unlocked position.
Figure 5D:
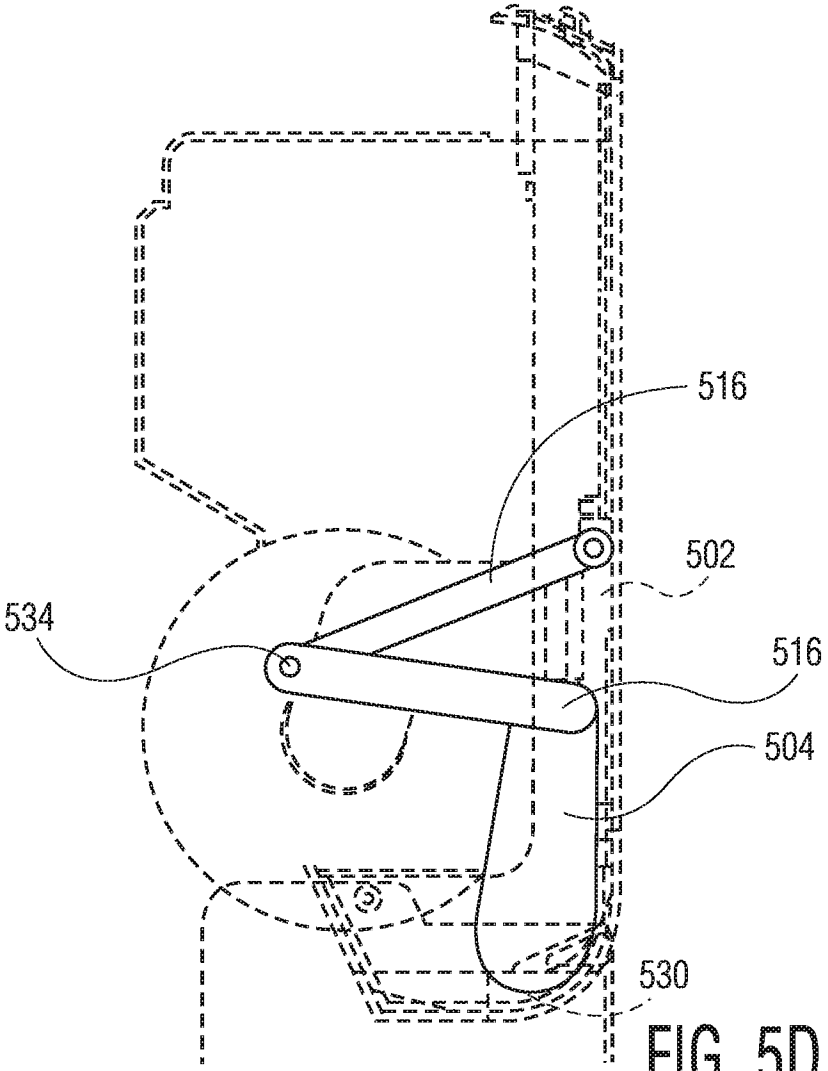
FIG. 5D is a view of the drop assembly of FIG. 5A in the collapsed position.
Figure 5C:
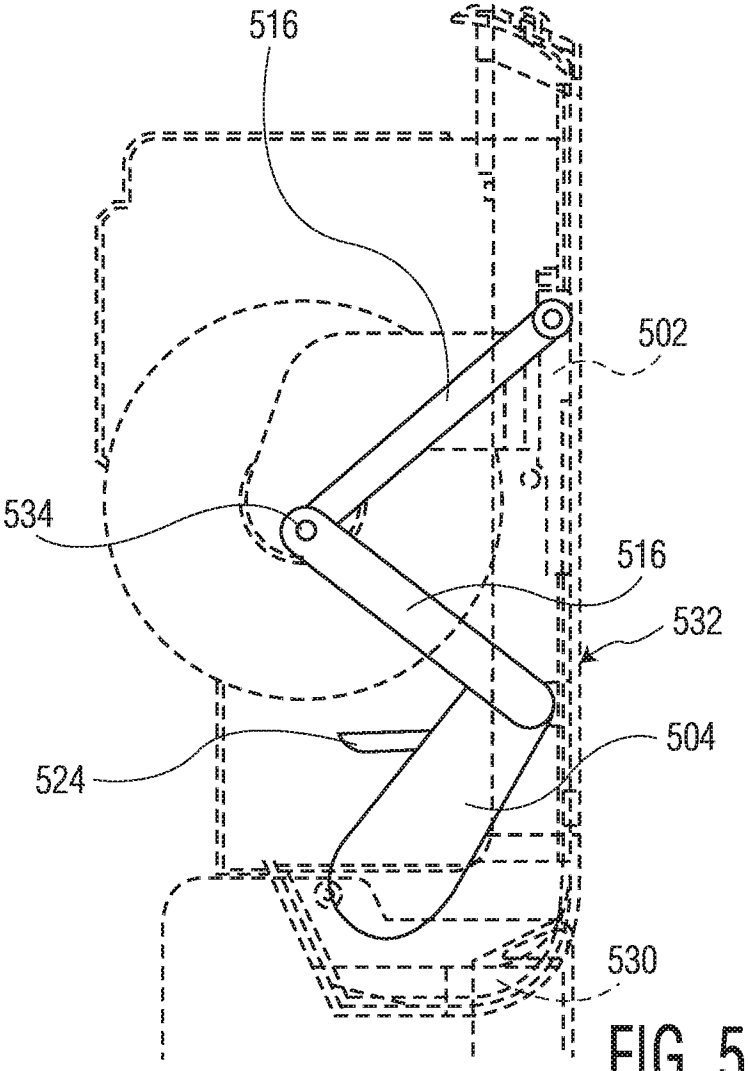
FIG. 5C is a view of the drop assembly of FIG. 5A in a partially collapsed position.

As discussed above, any of the discussed assemblies may also include a reset bar or assembly which returns the drop assembly to the first position. Referring to FIGS. 4A to 4C, a drop assembly 400 is shown that includes an upper carriage 402 having arms 406 and roll supports 410 and lower carriage 404 having arms 408 and roll supports 412. The drop assembly 400 is shown with locking mechanism 418 that contains latch 420, depletion gauge 422, and carriage support 416, however, it should be understood that the locking mechanism used in FIGS. 2A to 2E may also be used in the aspects shown in FIGS. 4A to 4C.

Nonetheless, as shown in FIGS. 4A to 4C, the drop assembly 400 may further include a reset mechanism 430. The reset mechanism 430 may include a cover connection 432, an upper carriage connection 434, and a lower carriage connection 436. Thus, referring to FIG. 4B, a drop assembly 400 located in a housing 450 for a dispenser 452 is shown in the collapsed position. In such a position, the lock or locking mechanism 418 has been unlocked, allowing the lower carriage 404 to drop into the collapsed position, and the upper carriage 402 to drop into the collapsed position, making the upper carriage 402 accessible through an aperture 454 in the housing 450. In such an aspect, at least a portion of the reset mechanism 430, such as the cover connection 432 may be attached to a front face 456 of the housing 450, such that, as shown in FIG. 4C, when the front face 456 of the housing 450 is opened, such as to replenish the paper product, the reset mechanism 430 transitions both the upper carriage 402 and lower carriage 404 back to the first position. In such a manner, a reset bar or mechanism may simplify and provide further sanitary benefits to the replenishment of a paper product. Nonetheless, as may be understood in the art, in one aspect, the resent mechanism may only include a cover connection, such as shown by reference character 432, and the locking mechanism may serve to transition the upper carriage 402 back to the first position.

Referring to yet a further aspect in FIGS. 5A-5D, a drop assembly 500 includes an upper carriage 502 having arms 506 with roll projections 210, and a lower carriage 504 having arms 508, and roll projections 512, where the roll projections 510, 512 have a roll adapter 514 thereon. Drop assembly 500 also includes a locking mechanism 518 that is held in the locked position by pressure from an inner side of the drop assembly, such as a pressure or contact generally shown by the direction of arrow 520. When the pressure or contact 520 is released, unlocking the mechanism (such as when a roll of paper product is depleted), the lower carriage 504 is allowed to rotate into the lower region 530 of a housing 532. Furthermore, the rotation of the lower carriage 504 also allows the carriage connection 516 to pivot around pivot point 534, facilitating the transition of the upper carriage 502 into the collapsed position, such a shown in FIG. 5D. As shown in FIGS. 5A-5D, the carriage connection 516 may have two distinct pieces with a central hinge or pivot point 534, and the lock 518 may again include a latch 524 maintaining the lower carriage 504 in the first position until the lock 518 is unlocked, allowing the transition into the collapsed position. As previously discussed, the aspects shown in FIGS. 5A-5D may also use the locking mechanism according to FIGS. 3A and 3B in one aspect.

Figure 6A:
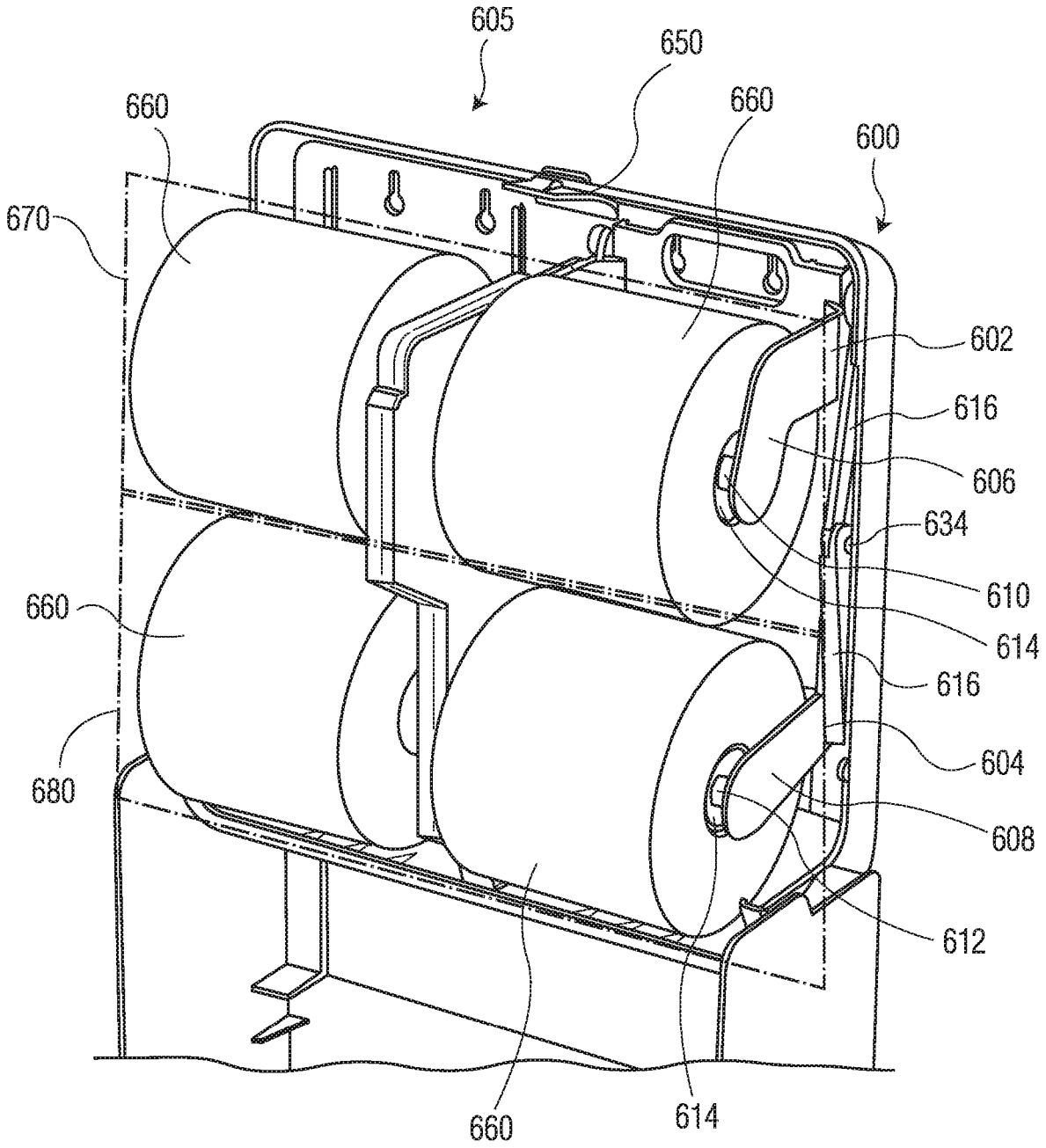
FIG. 6A is a view of a drop assembly according to an aspect of the present disclosure.
Figure 6B:
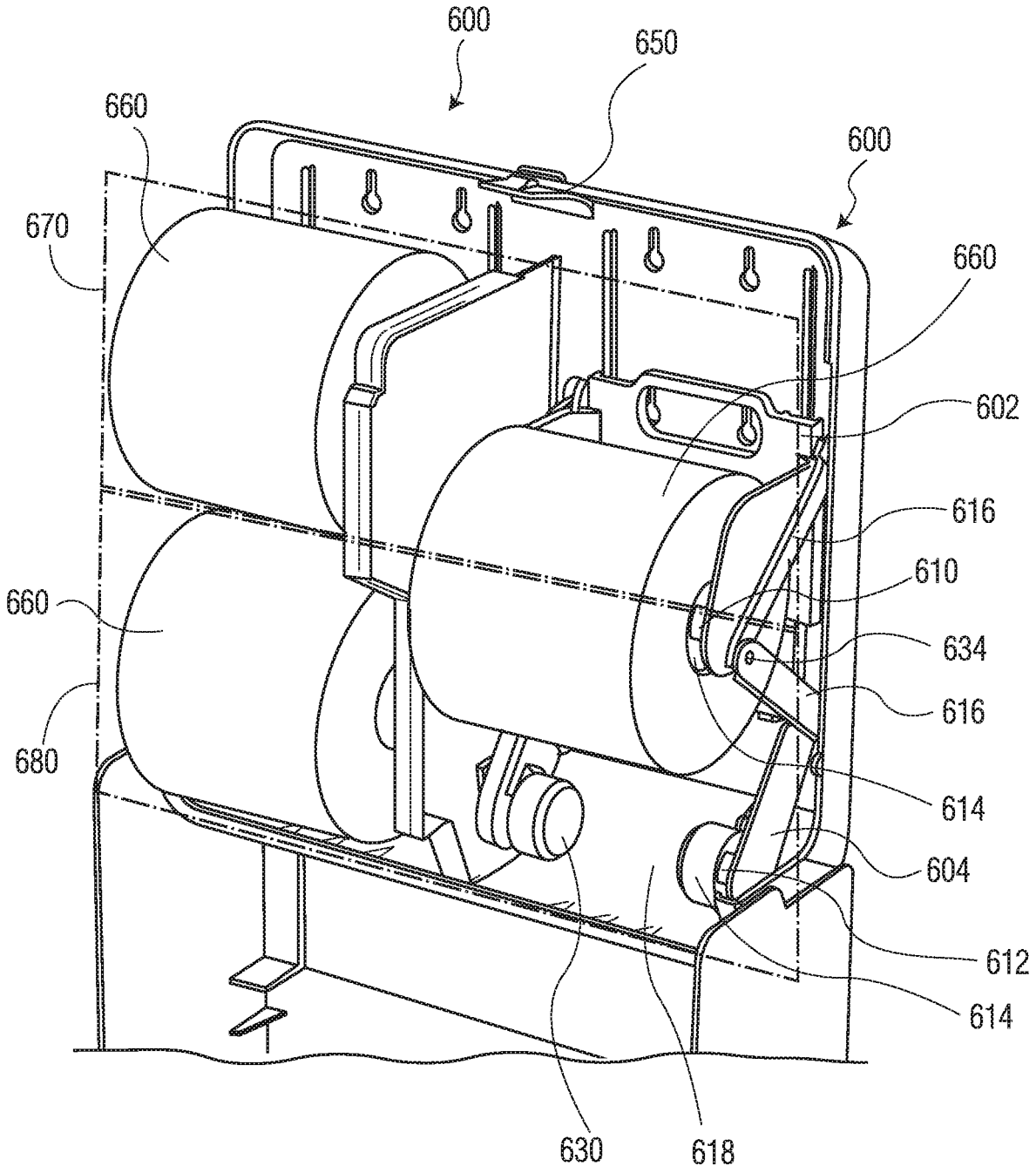
FIG. 6B is a view of the drop assembly according to FIG. 6A in a partially collapsed position.
Figure 6C:
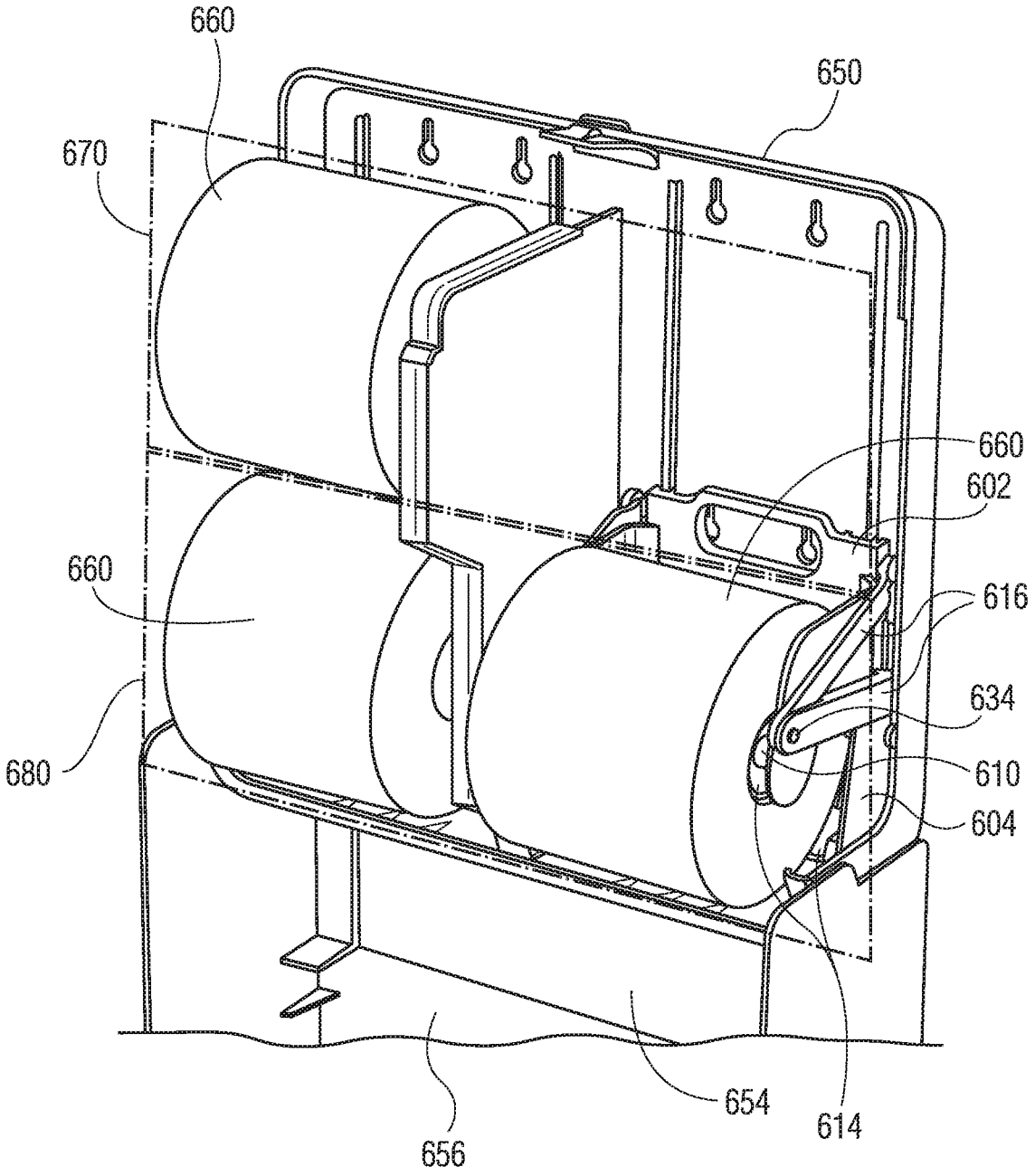
FIG. 6C is a view of the drop assembly according to FIG. 6A in the collapsed position.

Finally, referring to FIGS. 6A to 6C, an aspect is shown where two drop assemblies 600 are positioned adjacent to one another in a housing 650. Furthermore, as previously discussed, while the drop mechanism of FIGS. 5A-5D is shown for illustration, any of the drop assemblies discussed herein may have an adjacent configuration shown in FIGS. 6A-6C.

For instance, as shown in FIG. 6A, four rolls of paper product 660 may each be placed on individual roll supports 610, 612. In such an aspect, two rolls of paper product on upper carriages 602 are located in an upper region (area contained within dotted box 670), and two rolls 660 on lower carriages 604 are located in a lower region (such as the area contained within dotted box 680). As shown in FIG. 6B, the roll of paper product 660 that is placed on the lower carriage 604 is depleted first as access to the roll of paper product 660 on the upper carriage 602 is restricted, and when the roll 660 on the lower carriage 604 reaches a set diameter, the lock 618 is unlocked, allowing the lower carriage 604 to drop into the collapsed second position in the lower compartment 630 of the housing 650, and also allowing the upper carriage 602 to transition into the collapsed second position in the lower region 680, approximately the same position that had previously been occupied by lower carriage 604 prior to depletion of the roll of paper product 660. As shown in FIG. 6C, the upper carriage 602 has transitioned into the collapsed position in the lower region 680, which is a position approximately the same as the first position of the lower carriage 604, which allows the reserve roll 660 (located on roll supports 610 of the upper carriage 602) to be accessed by a user through an opening 654 in the front face 656 of the housing 650.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A drop assembly for a tissue dispenser,
the drop assembly having a first position, and a second collapsed position, the drop assembly comprising:
an upper carriage having a first arm, a second opposed arm, and a roll holder;
a lower carriage having a lock having a first arm, a second opposed arm, and a roll holder; and
a carriage support extending between the lower carriage and the upper carriage; and
wherein the carriage support releases at least one of the upper carriage, lower carriage, or both the upper and the lower carriage when the lock is unlocked, transitioning the drop assembly from the first position to the second collapsed position.

2. The drop assembly of claim 1, wherein the drop assembly in the first position has a first height from a center of the roll holder of the lower carriage to a center of the roll holder of the upper carriage.

3. The drop assembly of claim 2, wherein the drop assembly in the second position has a second height, from the center of the roll holder of the lower carriage to the center of the roll holder of the upper carriage, that is less than the first height.

4. The drop assembly of claim 1, wherein, the upper carriage defines a first location in the first position and the lower carriage defines a first location in the first position, and the upper carriage defines a second location in the second collapsed position and the lower carriage defines a second location in the second collapsed position.

5. The drop assembly of claim 4, wherein the location of the upper carriage is defined by a center of the roll holder of the upper carriage, wherein the second location of the upper carriage is approximately the same as the first location of the lower carriage.

6. The drop assembly of claim 4, wherein the location of the lower carriage is defined by a center of the roll holder of the lower carriage, wherein the second location of the lower carriage is below the first location of the lower carriage.

7. The drop assembly of claim 1, wherein the lower carriage further comprises at least one reset connection.

8. The drop assembly of claim 1, wherein the lock is maintained in the locked position by contact on an inner side of the lower carriage, and wherein the lock is unlocked when the contact is removed.

9. The drop assembly of claim 8, wherein the contact is provided by a roll of paper product.

10. The drop assembly of claim 9, wherein the contact is removed when the paper product reaches a diameter that is about 30% or less of an original diameter of the paper product.

11. The drop assembly of claim 9, wherein the roll holder is configured to releasably secure a roll of paper product to the at least one of the upper carriage, lower carriage, or both the upper carriage and lower carriage.

12. A paper product dispenser, comprising
a housing having at least one aperture; and
at least one drop assembly having a first position, and a second collapsed position, the at least one drop assembly comprising:
an upper carriage having a first arm, a second opposed arm, and a roll holder;
a lower carriage having a lock having a first arm, a second opposed arm, and a roll holder; and
a carriage support extending between the lower carriage and the upper carriage; and
wherein the support connection releases at least one of the upper carriage, lower carriage, or both the upper and lower carriage when the lock is unlocked, transitioning the drop assembly from the first position to the second collapsed position.

13. The paper product dispenser of claim 12, wherein the housing contains a back wall and a front face, wherein the front face is at least partially releasable from the back wall, and wherein the at least one aperture is located in a lower portion of the front face.

14. The paper product dispenser of claim 13, wherein the drop assembly further comprises at least one reset connection, wherein the at least one reset connection cooperates with the front face of the housing to transition the drop assembly from the second collapsed position to the first position when the front face is at least partially separated from the back wall.

15. The paper product dispenser of claim 12, wherein the aperture is sized such that only the lower carriage is accessible through the aperture in the first position and the upper carriage is accessible through the aperture in the second position.

16. The paper product dispenser of claim 12, wherein, in a first position, the upper carriage is located in an upper region of the housing and the lower carriage is located in a lower region of the housing.

17. The paper product dispenser of claim 12, wherein, in a second position, the upper carriage is located in the lower region of the housing in approximately the same location as the lower carriage in the first position.

18. The paper product dispenser of claim 12 wherein each of the at least one drop assemblies further contain at least two rolls of paper product, where a first roll of paper product is releasably affixed to a roll holder on the upper carriage and a second roll is releasably affixed to a roll holder on the lower carriage, such that the first roll is vertically stacked above the second roll, wherein the second roll maintains the lock in the compressed position.

19. The paper product dispenser of claim 12, wherein the lock is unlocked when the second roll reaches a diameter that is about 30% or less of an initial diameter of the second roll.

20. The paper product dispenser of claim 12, wherein the tissue dispenser comprises at least two drop assemblies, wherein a first drop assembly is located adjacent to a second drop assembly.

* * * * *